US005619215A

United States Patent [19]

Sydor

[11] Patent Number: 5,619,215

[45] Date of Patent: Apr. 8, 1997

[54] COMPACT ANTENNA STEERABLE IN AZIMUTH AND ELEVATION

[75] Inventor: John T. Sydor, Ottawa, Canada

[73] Assignee: Her Majesty the Queen in right of Canada, as represented by the Minister of Communications, Ottawa, Canada

[21] Appl. No.: 500,243

[22] Filed: Jul. 10, 1995

[51] Int. Cl.[6] ..... H01Q 3/08

[52] U.S. Cl. ..... 343/766; 343/765; 343/882

[58] Field of Search ..... 343/757, 758, 343/759, 761, 763, 765, 766, 882, 895, 872; 248/183; H01Q 3/08, 3/00, 3/12

[56] References Cited

U.S. PATENT DOCUMENTS

| | | | |
|---|---|---|---|
| 3,407,404 | 10/1968 | Cook et al. | 343/765 |
| 3,510,877 | 5/1970 | Turriere | 343/760 |
| 3,987,451 | 10/1976 | Peterson | 343/765 |
| 4,295,621 | 10/1981 | Siryj | 343/765 |
| 4,538,155 | 8/1985 | Stewart | 343/715 |
| 4,636,802 | 1/1987 | Middleton, Jr. | 343/895 |
| 4,690,473 | 9/1987 | Chung | 439/1 |
| 4,887,091 | 12/1989 | Yamada | 343/714 |
| 5,022,861 | 6/1991 | Aoto | 439/13 |
| 5,025,262 | 6/1991 | Abdelrazik et al. | 343/766 |
| 5,281,975 | 1/1994 | Hugo | 343/766 |
| 5,337,062 | 8/1994 | Sherwood et al. | 343/765 |
| 5,419,521 | 5/1995 | Matthews | 343/765 |
| 5,432,524 | 7/1995 | Sydor | 343/766 |

FOREIGN PATENT DOCUMENTS 1572735 5/1969 France .

OTHER PUBLICATIONS

NTIS Tech Notes, May 1990, Springfield, Va., US. pp. 394–395. Bell et al *Mechanically–Steered, Mobile Satellite–Tracking Antenna.*

*Primary Examiner*—Donald T. Hajec
*Assistant Examiner*—Tan Ho
*Attorney, Agent, or Firm*—Thomas Adams

[57] ABSTRACT

A compact, mechanically-steered antenna especially applicable for mobile terminals for receiving signals broadcast by satellites, is adjustable in azimuth and elevation. The antenna's active element can be rotated in azimuth through 360 degrees. Rotary couplings in the signal path are avoided by means of a flexible coupling. The flexible coupling conveniently comprises a torsion spring and the feedline, typically a highly-flexible coaxial cable, passes through it. The active element is mounted upon a first support member and rotatable relative to it about the boresight of the antenna. A second support member is mounted upon a base member and rotatable relative to it in azimuth. The first second support is mounted upon the second support by means of a hinge coupling which permits pivoting of one support member relative to the other to adjust the elevation angle. Pivoting of the support members relative to each other is effected by longitudinal displacement of the flexible coupling which is fixed at one end to the antenna element and extends slidably through the second support member. A drive motor rotates the second support member and a linear actuator displaces the flexible coupling. Sensors detect the azimuthal angle.

6 Claims, 5 Drawing Sheets

COMPACT ANTENNA STEERABLE IN AZIMUTH AND ELEVATION

BACKGROUND OF THE INVENTION

1. Technical Field

This invention relates to antennas and is especially concerned with drive arrangements for mechanically-steered antennas. The invention is especially, but not exclusively, applicable to antennas for mobile terminals for receiving signal broadcast by satellites and to low cost personal communications terminals requiring steerable, directional antennas.

2. Background Art

In order to maintain adequate reception, it is desirable for a vehicle-mounted antenna to include a directional antenna element or array of elements which can be rotated in azimuth relative to the vehicle so as to track a satellite or other radio signal source as the orientation of the vehicle changes. The antenna element disclosed in U.S. Pat. No. 4,887,091 (Yamada) comprises a reflector which can be folded between open and closed positions. The open position, and hence the elevation angle of the antenna, can be preset using set screws which limit the extent to which the reflector is pivoted when opened. The antenna can be rotated in azimuth by means of a drive motor. A rotary connector in the signal path allows for 360 degrees of rotation. The rotary connector ensures that the signal cable connected between the antenna element and the vehicle will not be damaged by repeated twisting resulting from rotation of the antenna. The connector must be small, low-loss and highly reliable to work in mobile and personal terminals or like high vibration environments. In the event it is used for consumer communications products, it must also be low cost and easy to manufacture. One disadvantage with a stand-alone rotary connector is that its use in antennas which are adjustable in elevation and azimuth makes mechanical construction of the antennas difficult.

Antennas disclosed in French patent No. 1,572,735 and the present applicant's PCT application number WO 94/21002 (or U.S. Ser. No. 08/024,461) permit 360 degrees of rotation without using rotary connectors. In both of these antennas, the antenna element is mounted upon a base member by means of a support which is rotatable in azimuth. The antenna element is connected to the base member by a flexible coupling. Rotation of the antenna element in azimuth is accompanied by rotation of the antenna element about its own boresight axis as a result of torsional forces in the flexible coupling. Although these antennas avoid the use of rotary connectors they do not permit adjustment of elevation angle.

An object of the present invention is to provide for adjustment of the antenna element of such an antenna in elevation as well as in azimuth.

SUMMARY OF THE INVENTION

To this end, according to the present invention, a mechanically-steerable antenna comprises a base member, an active antenna element, a first support member and a second support member, the second support member mounted upon the base member and the first support member hingedly mounted upon the second support member and supporting the active antenna element, the first second support member being rotatable relative to the base member about a first axis of rotation and the antenna element being rotatable relative to the first support member about a second axis of rotation inclined relative to the first axis, the first and second support members being adjustable one relative to the other to vary the angle of inclination between the first axis and the second axis; the antenna further comprising drive means for rotating the second support member relative to the base member about said first axis, flexible coupling means connected non-rotatably between the antenna element means and the base member, the arrangement being such that, upon relative rotation of the second support member and the base member about said first axis, the flexible coupling means causes rotation of the antenna element means relative to the first support member about said second axis, and elevation adjusting means for displacing the flexible coupling so as to adjust the position of one of the first and second support members relative to the other and vary said angle of inclination.

In preferred embodiments of the invention, a first beating means couples the second support member to the base member and a second bearing means couples the antenna element to the first support member. The flexible coupling is tubular and extends between respective inner components of the first and second beating means. A feedline in the form of a coaxial cable is connected at one end to a radiator element of the antenna element, and passes through the second bearing means, flexible coupling and first bearing means.

In one embodiment of the invention, the base member is hollow and the second support is mounted to the base member by a bearing assembly comprising a hollow shaft extending through a wall of the base member, the shaft being slidable longitudinally relative to a rotation axis of the bearing, the flexible coupling being anchored relative to the shaft, the antenna further comprising a drive motor connected to the shaft by a drive coupling whereby longitudinal displacement of the shaft causes longitudinal displacement of the flexible coupling to vary the angle of inclination. Preferably, the shaft has a screwthreaded portion engaging a correspondingly screwthreaded portion of a mounting for the shaft, the drive coupling comprising a ring gear carried by the shaft engaging a pinion of the drive motor, whereby rotation of the shaft is translated by the screwthreaded parts to produce the longitudinal displacement.

In an alternative embodiment of the invention, the elevation adjusting means comprises an actuator mounted upon the base member, the actuator providing linear displacement of the flexible coupling to and fro relative to the base member.

Various objects, features, aspects and advantages of the present invention will become more apparent from the following detailed description, taken in conjunction with the accompanying drawings, of preferred embodiments of the invention, which are described by way of example only.

DESCRIPTION OF THE PREFERRED EMBODIMENTS

Figure 1:
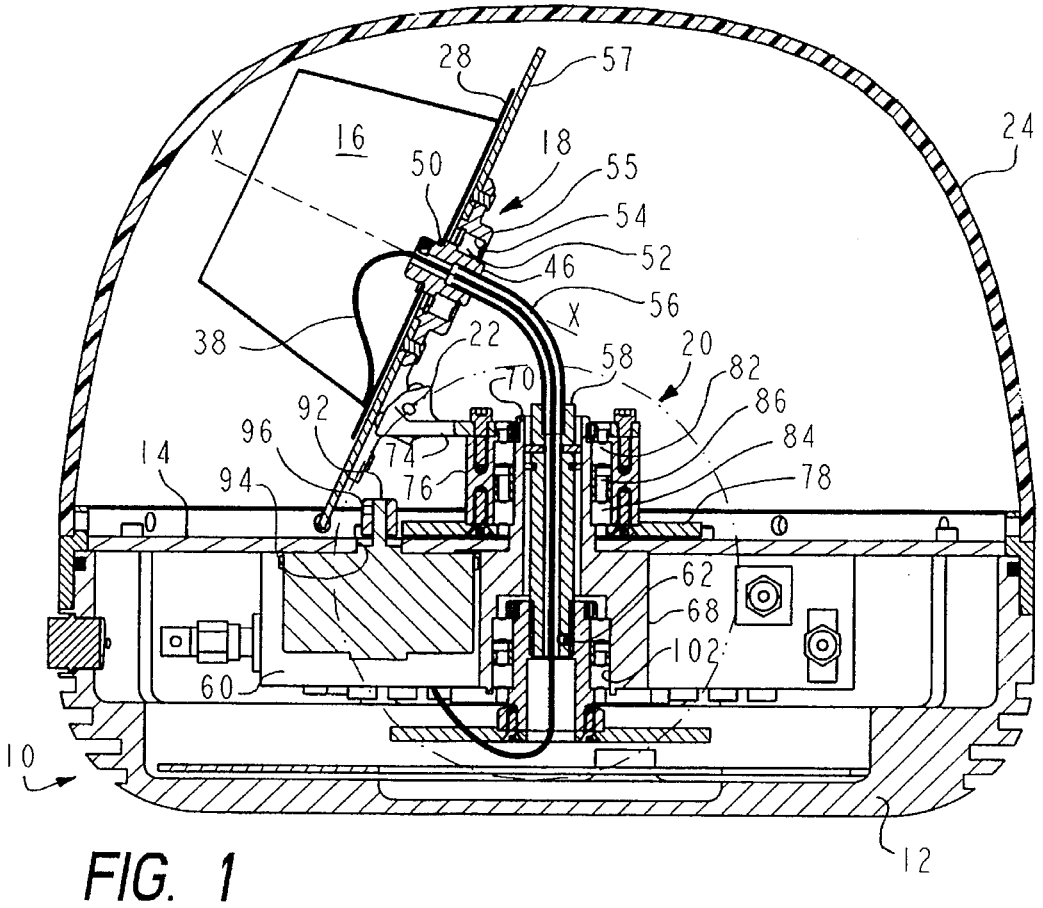
FIGS. 1 and 2 are cross-sectional views of a first antenna embodying the invention, each showing the active antenna element at a different elevation angle.
Figure 5:
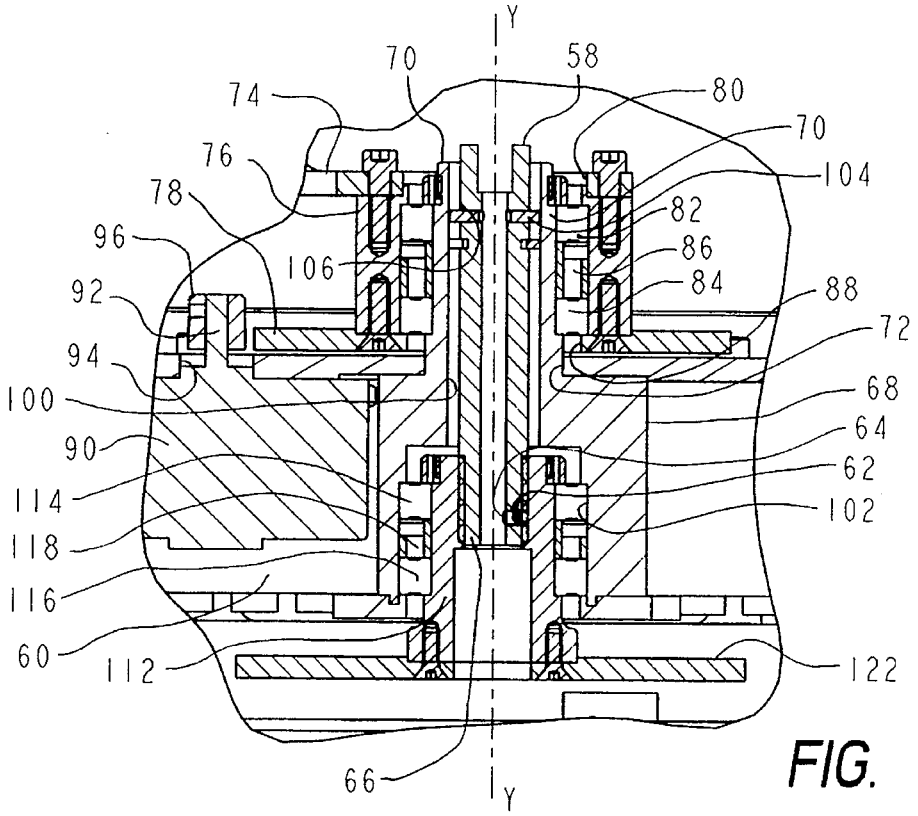
FIG. 5 is a detail view of part encircled by a chain-link line in FIG. 1, omitting the signal cable for greater clarity.

In the drawings, like reference numbers are used to identify like components in the different views.

Figure 2:
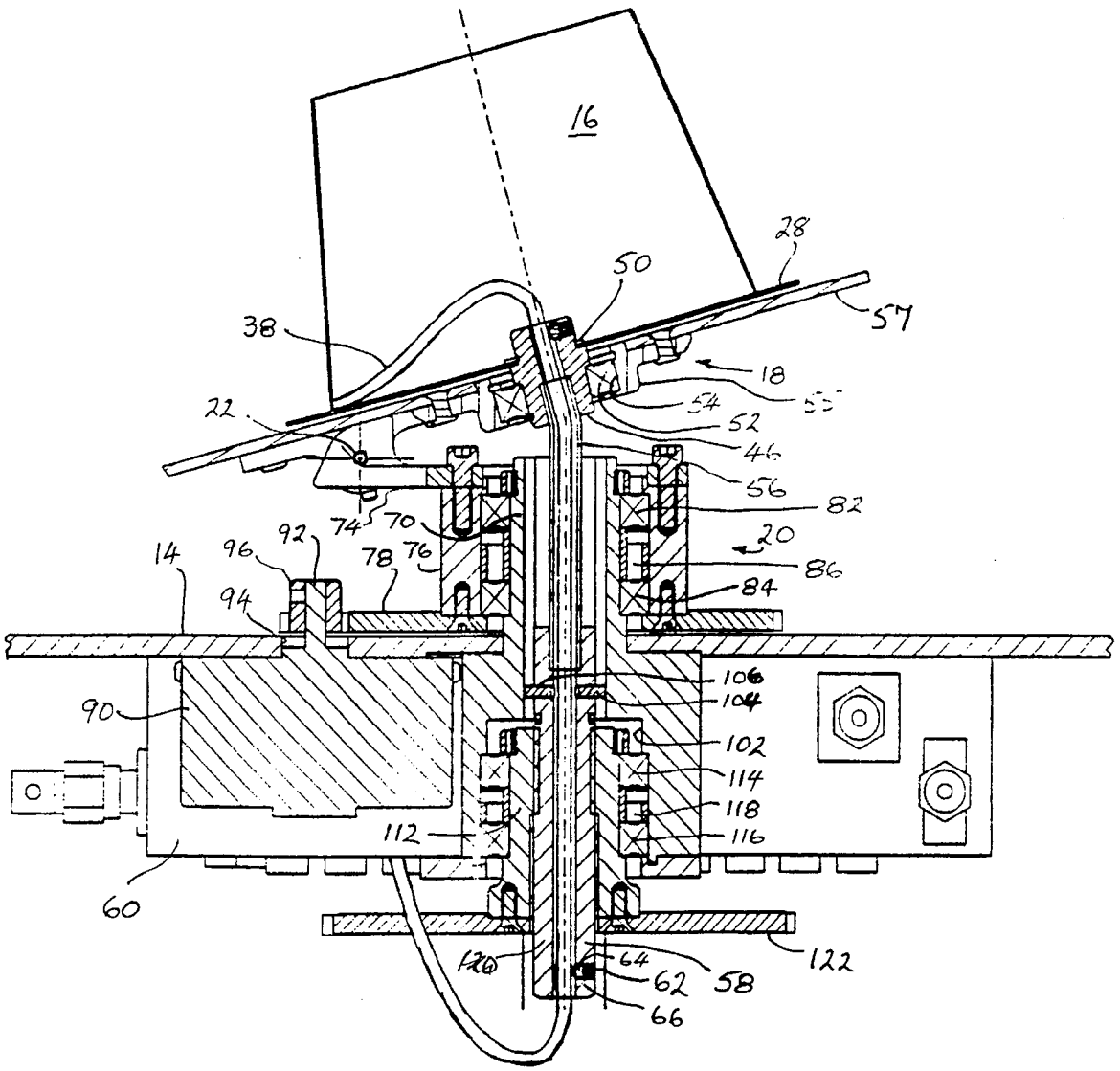
Figure 3:
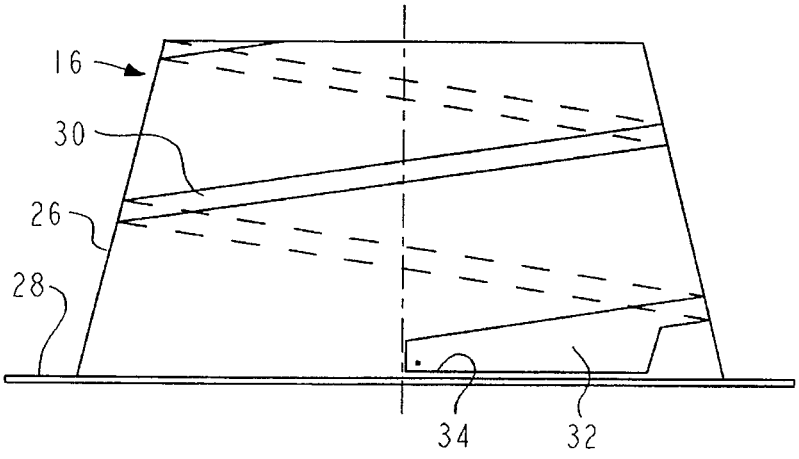
FIG. 3 is a side view of an active antenna element of the antenna of FIGS. 1 and 2.
Figure 4:
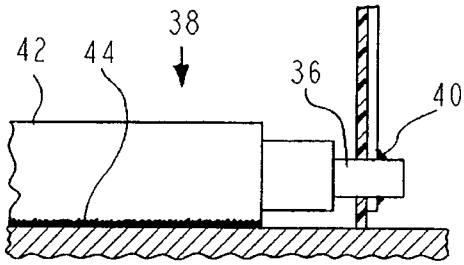
FIG. 4 is a detail view of a part of the active antenna element of FIG. 2.

Referring first to FIGS. 1, 2, 3, 4 and 5, a mechanically steerable antenna for mounting upon a vehicle for communication, via satellite, of mobile radio communications, telephony, data, direct audio broadcasts, or other such signals, comprises a hollow, generally circular base member 10, formed by a dished part 12 with a cover plate 14, and an active antenna element 16 mounted upon the cover plate 14 by support means formed by a first support member 18 and a second support member 20 hingedly coupled together by bearings 22 (only one shown). The active antenna element 16 is covered by a radome 24 which is attached by its periphery to the rim of the dished part 12. As shown in FIG. 3, the antenna element 16 comprises a frustum or truncated cone 26 of flexible printed circuit board material with its base bonded to a circular ground plane 28 made of suitable conductive metal such as copper, aluminium, magnesium and so on. The ground plane 28 may conveniently be formed of printed circuit board material also. The antenna element 16 comprises a radiator (or receptor) element in the form of a short, helical copper conductor 30 printed upon the conical printed circuit board substrate 26. The helical conductor 30 terminates at its maximum diameter end in an impedance matching transformer 32. The matching transformer 32 comprises a wedge-shaped continuation of the end portion of the conductor 30. The lower edge 34 of the matching transformer 32 is positioned adjacent the ground plane 28. The length of the helical conductor 30, excluding the matching transformer 32, is about one and three quarters turns. (For more information about such an antenna element, the reader is directed to international patent application number PCT/CA 94/00050). As shown in FIG. 4, the core 36 of a coaxial feed cable 38 extends through aligned holes in the cone 26 and matching transformer 32 and is soldered to the latter as indicated at 40. The outer shield 42 of the cable 38 is soldered to the ground plane 28 as indicated at 44.

As shown in FIGS. 1 and 2, the antenna element 16 is mounted upon a hollow spindle 46, which extends through a hole 48 in the centre of the ground plane 28, and is secured by a circlip 50. The spindle 46 is mounted in a bearing 52 which is supported in a hole 54 in a flanged housing 55 which is attached to a backplate 57, forming the first support member 18. The bore of spindle 46 is enlarged at its end facing the base 10 to receive one end of a cylindrical torsion spring 56 constituting a flexible coupling.

The other end of the torsion spring 56 is an interference fit in a hollow shaft 58 which extends, vertically as shown, through the centre of the base member 10. The cable 38 extends through the spindle 46, torsion spring 56 and tubular shaft 58 and emerges in the base member 10 where it is connected to a diplexer 60 or other signal circuitry. A spring-loaded pin 62 protrudes from a transverse hole 64 in the lower end portion 66 of shaft 58 to clamp the cable 38 within the shaft 58.

The shaft 58 is mounted in a block 68 which is fixed to the underside of cover plate 14. A tubular spigot portion 70 of the block 68 protrudes upwards through a hole 72 in the cover plate 14. The second support member 20 comprises three parts; a flat plate 74, a cylindrical boss 76 and a ring gear 78. The flat plate 74 is attached to the upper end of the boss 76 and has a central clearance hole 80 for the shaft 58. The flat plate 74 extends in cantilever fashion from boss 76 and carries the bearing 22 at its distal end. The cylindrical boss 76 surrounds the protruding tubular portion 70 and is rotatably mounted upon it by a pair of bearings 82 and 84 separated by a cylindrical spacer 86. The ring gear 78 is attached to the lower end of the boss 76 and has a clearance hole 88 for the protruding spigot portion 70. An azimuth drive motor 90 is mounted to the underside of the cover plate 14 with its drive shaft 92 protruding upwards through a hole 94 in the cover plate 14. A pinion 96 carried by the drive shaft 92 engages the ring gear 78 to rotate the boss 76 about tubular portion 70, and hence the antenna element 16 in azimuth about axis Y—Y which is coaxial with shaft 58. As the support member 20 rotates, torsional forces in the torsion spring 56 will cause the antenna element 16 to rotate about boresight axis X—X as it also rotates bodily around vertical axis Y—Y.

The shaft 58 is a sliding fit in a cylindrical hole 100 which extends through the protruding portion 70 of the block 68 and into a cavity 102 in the lower portion of the block 68 beneath the cover plate 14. Diametrically opposite guide pins 104 and 106 protrude from the shaft 58 to engage in respective longitudinal grooves 108 and 110 in the wall of cylindrical hole 100. The guide pins 104 and 106 prevent rotation of the shaft 58 while allowing it to slide up and down, as will be explained later.

Figure 6:
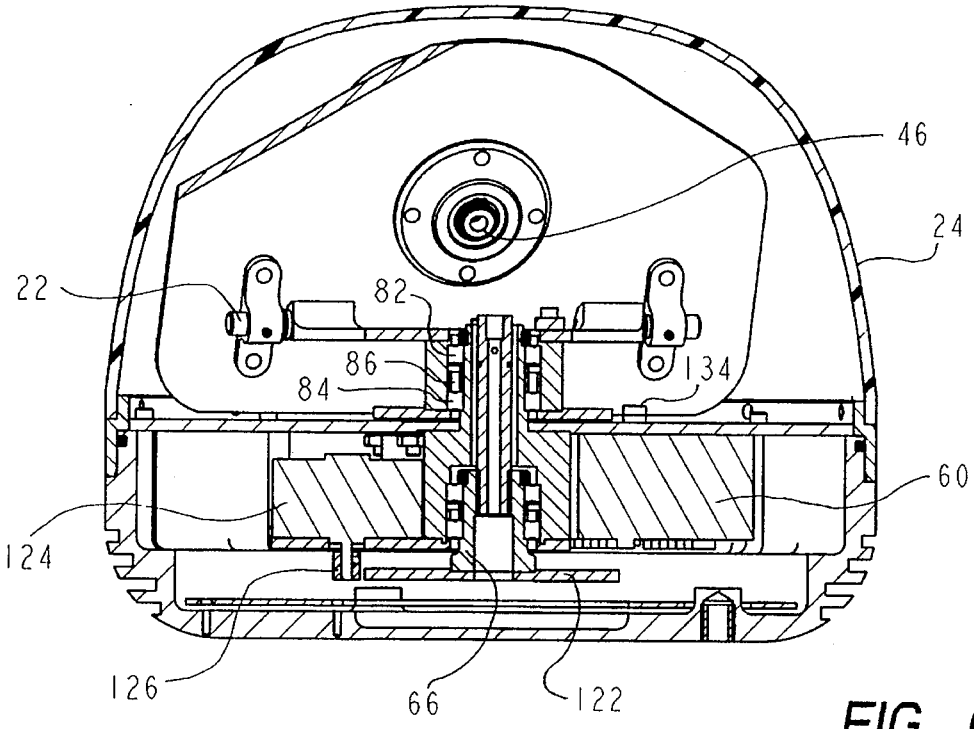
FIG. 6 is a transverse cross-sectional view of the antenna of FIG. 1 taken on axis Y—Y, omitting the signal cable for greater clarity.

The cavity 102 houses a tubular member 112 which is mounted in a pair of bearings 114 and 116 separated by a cylindrical spacer 118. The end portion 120 of the shaft 58 extends into the tubular member 112. The exterior of the shaft end portion 120 is screwthreaded and cooperates with the correspondingly screwthreaded interior of tubular member 112. A second ring gear 122 is attached to the lower end of tubular member 112. As shown in FIG. 6, an elevation drive motor 124 mounted to the underside of cover plate 14 has a drive pinion 126 which engages the second ring gear 122 to rotate the second ring gear 122, and hence the tubular member 112, relative to block 68. As tubular member 112 rotates, the screwthreaded end portion 120 of shaft 58 will be caused to move into or out of tubular member 112 causing the shaft 58 to move upwards or downwards. As the shaft 58 moves downwards, it will draw the end of torsion spring 66 towards the base member 10, causing the antenna element 16 to tilt upwards, increasing the elevation angle between boresight axis X—X and the azimuthal plane (through cover plate 14). Conversely, as the shaft 58 moves upwards, it will tilt the antenna element 16 downwards, reducing the elevation angle.

An optical encoder 134, reading markings on box 76, detects the azimuthal positions and supplies corresponding signals to control circuity (not shown). As can be seen from FIGS. 1 and 2, the elevation angle can be varied between about 20 degrees and about 80 degrees. For use with the MSAT satellite system, a mean elevation angle is about 40 degrees.

Usually, the antenna will be mounted with the axis Y—Y substantially vertical, as shown, so that rotation of the second support member 20 allows steering of the antenna element 16 in azimuth. Tilting of the first support member 18 about the hinge coupling, i.e. bearing 22, adjusts elevation angle. It should be appreciated, however, that the antenna could be mounted with its axes differently oriented, and references to "vertical" and other specific orientations in this description are for convenience only.

A second embodiment of the invention, particularly suitable for aircraft, will now be described with reference to FIGS. 7 and 8 in which components which are the same as components of the antenna of FIGS. 1–5 have the same reference numbers. The main difference, as compared with the antenna described with reference to FIGS. 1–6 is that the antenna of FIGS. 7 and 8 has a generally planar base plate 140. The antenna element 16, first support member 18 and second support member 20 are similar to those of the antenna of FIGS. 1–6. As before, the second support member 20 comprises a flat plate 74, cylindrical boss 76 and ring gear 78. The boss 76 is rotatable about a tubular spigot 70 which is carried by a pedestal member 142, mounted upon baseplate 140.

The azimuth drive motor 90 is generally flat and accommodated partly in a hole 144 in the baseplate 140, being supported by a plate 146 extending across the hole 144 on the underside of baseplate 140. The azimuth motor 90 has a central drive shaft 92 protruding upwards and carrying a drive pinion 96 which engages ring gear 78 on 70 to rotate the second support member 20 in azimuth, as before.

The bore 148 of the spigot 70 communicates with a passage 150 in the pedestal member 142. The passage 150 opens onto the upper surface of the pedestal member 142 and curves downwards and rearwards i.e. away from the antenna element) to open onto the rear face of the pedestal member 142. Hence, the passage 150 provides a 90 degree turn for the flexible coupling, torsion spring 56, which extends through it.

The flexible coupling, torsion spring 56 follows the contour of the passage 150 but with sufficient clearance that it can slide to and fro. Hence, it enters the pedestal member 142 vertically but extends horizontally at the rear of the pedestal member 142. A cylindrical sleeve 152 protrudes rearwardly from the pedestal member 142 towards a linear actuator assembly 154 mounted upon baseplate 140 rearwardly of the pedestal member 142. The linear actuator assembly 154 comprises a housing forming a rectangular chamber 156 and, to the rear of the chamber 156, a support wall 158 carrying a linear actuator motor 160. The motor 160 is mounted upon the rear face of support wall 158. Its actuator arm 162 extends across the chamber 156 generally parallel to the baseplate 144. The end of torsion spring 56 adjacent the rear of pedestal member 142 is connected to a conduit 164 which extends through a hole 166 in the front wall 168 of the housing. Inside the chamber 156, the conduit 164 extends into, and is secured in, a hole 170 in a sliding shackle 172, which is attached to the end of actuator arm 162. The coaxial signal cable 38 enters the torsion spring 66 by way of spindle 56, as before, but in this antenna emerges from the hole 170 in sliding shackle 172. As before, the coaxial signal cable 38 will be connected to a diplexer or other circuitry (not shown).

Figure 8:
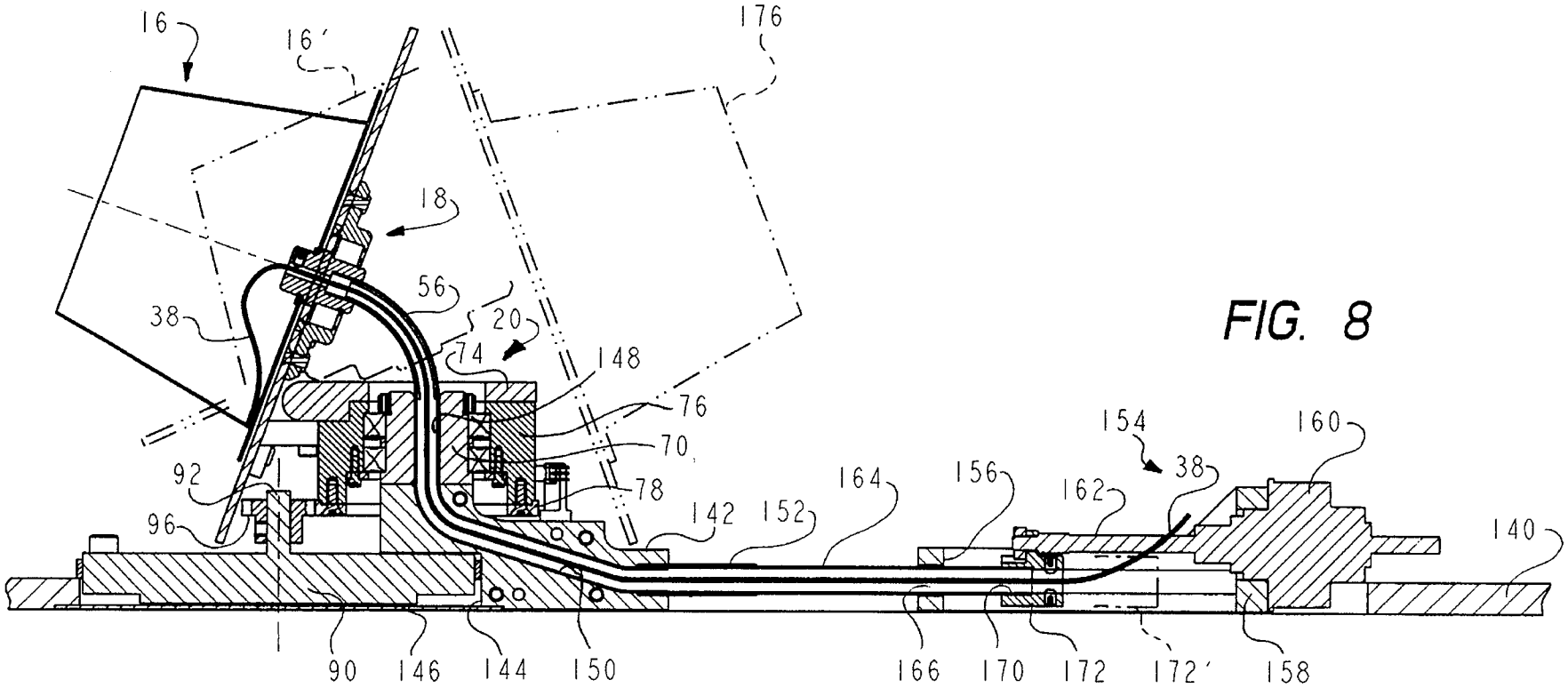
FIG. 8 is a longitudinal cross section of the antenna of FIG. 7.

With linear actuator arm 162 extended, as shown in FIG. 8, the torsion spring 56 is at it maximum extension from the second support member 20 and the elevation angle is a minimum. Operation of the linear actuator motor 160 withdraws actuator arm 162, and conduit 164, causing torsion spring 56 to slide along the passage 150 in pedestal member 142, tilting the first support member 18, and antenna element 16, about hinge 22. Upon full retraction of the actuator arm 162 withdrawing the sliding shackle 172 to the position 172' shown in broken lines in FIG. 8, the antenna element 16 will be in its maximum elevation position as indicated partially by dashed lines 16'. In this position, the entire antenna element 16 can still be rotated through 360 degrees in azimuth, the 180 degree position being shown in broken lines at 176.

In either embodiment, as the support member 20 rotates relative to the base member 10 about the vertical rotation axis Y—Y, the torsion spring 56 will prevent rotation of the antenna element 16 relative to the base member 10. As a result, the antenna element 16 will rotate oppositely about the rotation axis X—X through spindle 46, which is also the boresight axis of the antenna element 16. Hence, as the antenna element 16 rotates about the boresight axis, it will sweep an arc around the azimuth rotation axis Y—Y of shaft 58. At the same time, the cylindrical torsion spring 56 will flex relative to its own cylindrical axis—although it does not, itself, rotate about that axis. Likewise, the coaxial cable 38 will flex as the antenna element 16 rotates. It should be appreciated that the torsion spring 56 and coaxial cable 38 may experience some twisting as torsional forces are built up, but these will be released as the antenna element 16 rotates so that neither the torsion spring nor the coaxial cable is permanently twisted. The coaxial cable 38 must be able to tolerate repeated flexing and some twisting. A cable employing a laminated Teflon (Trade Mark) dielectric and conductors of wrapped silver foil and highly stranded silver coated copper has been found to be satisfactory. Suitable cables are marketed by Goretex Cables Inc. as Gore Type 4M and Gore Type 4T.

The radiation pattern of antenna element 16 is symmetrical about its boresight axis X—X, so its rotation about the boresight axis does not have any significant effect upon the gain of the antenna. Adjustment of the elevation angle permits the gain of the antenna to be optimized and permits the use of antenna elements which have lower intrinsic gain than that described herein.

The mechanical steering arrangements shown and described herein may be used with many kinds of antenna element, for example circular, square, pentagonal, microstrip patches or dielectrically loaded Yagi antenna elements. It will be appreciated that an array of two or more of the antenna elements 16 could be mounted upon the first support member 18.

It will also be appreciated that automatic adjustment of the elevation angle could be coordinated with the rotation of the support member about the vertical axis so as to compensate automatically for any lack of symmetry of the antenna radiation pattern.

The antenna may be mounted in various ways. For example, the base member 16 may be mounted upon the roof of an automobile or boat. Because it is so compact, in the case of trucks, the antenna of FIGS. 1 and 2 could be mounted upon a mast so that it is not overshadowed. The mass of the antenna element 16 and its supporting components may be relatively low, thereby reducing the risk of damage caused by inertial forces during acceleration/deceleration. The design readily lends itself to fabrication of many of the parts using plastics which will further reduce weight and increase durability.

Figure 7:
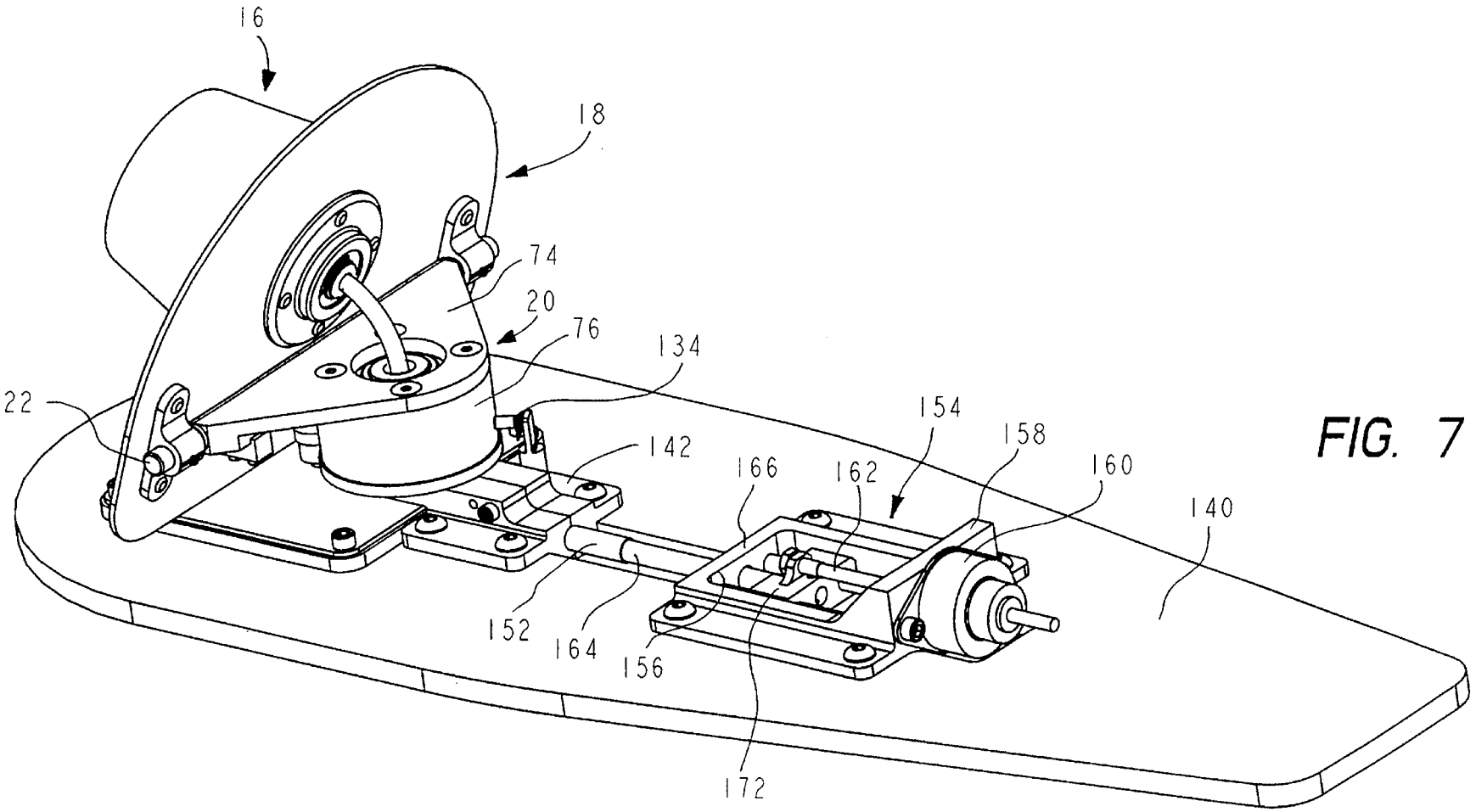
FIG. 7 is a pictorial view of a second embodiment of the invention.

The antenna of FIGS. 7 and 8 is especially suitable for mounting upon the fuselage of an aircraft. While the specific embodiments described herein would be attached to an existing vehicle, it is envisaged that embodiments of the invention could be integral, being installed during manufacture. This could lead to further savings since the base member, for example, could be a structural part of the vehicle, such as its roof.

Although embodiments of the invention have been described and illustrated in detail, it is to be clearly understood that the same are by way of illustration and example only and not to be taken by way of limitation, the spirit and scope of the present invention being limited only by the appended claims.

What is claimed is:

1. A mechanically-steerable antenna comprising:

a base member;

an active antenna element;

a first support and a second support, the second support mounted upon the base member and the first support supported by, and connected hingedly to, the second support, the first support supporting the active antenna element, the second support being rotatable relative to the base member about a first axis of rotation and the antenna element being rotatable relative to the first support about a second axis of rotation inclined relative to the first axis, the first and second supports being adjustable one relative to the other to vary the angle of inclination between the first axis and second axis;

drive means for rotating the second support relative to the base member;

flexible coupling means interconnecting the base member and the active antenna element;

the flexible coupling means being connected non-rotatably to the active antenna element and to the base member, respectively, the arrangement being such that, upon rotation of the second support relative to the base member about said first axis, the flexible coupling means causes rotation of the active antenna element relative to the first support about said second axis, and elevation adjusting means for displacing the flexible coupling means so as to adjust the position of one of the first and second supports relative to the other and vary said predetermined angle.

2. An antenna as claimed in claim 1, wherein the base member is hollow and the second support is mounted to the base member by a bearing assembly comprising a hollow shaft extending through a wall of the base member, the shaft being slidable longitudinally relative to a rotation axis of the bearing assembly, the flexible coupling being anchored relative to the shaft, the antenna further comprising a drive motor connected to the shaft by a drive coupling whereby longitudinal displacement of the shaft causes longitudinal displacement of the flexible coupling to vary the angle of inclination.

3. An antenna as claimed in claim 2, wherein the shaft has a screwthreaded portion engaging a correspondingly screwthreaded portion of a mounting for the shaft, the drive coupling comprising a ring gear carried by the shaft engaging a pinion of the drive motor whereby rotation of the shaft is translated by the screwthreaded parts to produce the longitudinal displacement.

4. An antenna as claimed in claim 1, wherein elevation adjusting means comprises an actuator mounted upon the base member, the actuator providing linear displacement of the flexible coupling to and fro relative to the base member.

5. An antenna as claimed in claim 1, wherein, said first axis of rotation is substantially perpendicular to a plane of the base member, the second support is carried by a pedestal member, the flexible coupling being routed by the pedestal member to extend parallel to said plane, the elevation adjusting means comprising an actuator mounted upon the baseplate and providing linear displacement of the flexible coupling to and fro relative to the baseplate.

6. An antenna as claimed in claim 1, wherein the antenna element comprises a radiator element, a first bearing means couples the second support to the base member, a second bearing means couples the antenna element to the first support, the flexible coupling is tubular and extends between respective inner components of the first and second bearing means and a signal feedline is connected at one end to the radiator element and passes through the second beating means, the flexible coupling and the first bearing means.

* * * * *